United States Patent [19]

Blomberg

[11] 4,242,879

[45] Jan. 6, 1981

[54] CONTROL SYSTEM FOR A REFRIGERATING APPARATUS OPERABLE ELECTRICALLY OR BY GAS

[75] Inventor: Peter E. Blomberg, Stockholm, Sweden

[73] Assignee: Aktiebolaget Electrolux, Stockholm, Sweden

[21] Appl. No.: 49,542

[22] Filed: Jun. 18, 1979

[30] Foreign Application Priority Data

Jun. 19, 1978 [SE] Sweden ..... 7806991

[51] Int. Cl.[3] ..... F25B 15/00; F25B 27/00; F25B 27/02; B60H 3/04

[52] U.S. Cl. ..... 62/148; 62/236; 62/238 B; 62/239; 62/476

[58] Field of Search ..... 62/148, 236, 238 B, 62/239, 476; 219/279; 431/6, 43, 259

[56] References Cited

U.S. PATENT DOCUMENTS

| | | | |
|---|---|---|---|
| 3,093,978 | 6/1963 | Grubb | 62/236 |
| 3,105,363 | 10/1963 | Von Der Scher | 62/236 |
| 3,177,677 | 4/1965 | Boren et al. | 62/236 |
| 3,225,560 | 12/1965 | Doebeli | 62/236 |
| 3,295,334 | 1/1967 | Hultgren | 62/148 |
| 4,147,494 | 4/1979 | Ando et al. | 62/148 |

*Primary Examiner*—Lloyd L. King
*Attorney, Agent, or Firm*—Alfred E. Miller

[57] ABSTRACT

An absorption refrigeration system has an electric heater connectable to an electric power source, and a gas burner connectable to a gas supply. A voltage responsive circuit is connected to disable the gas burner circuit when the voltage of an electric supply means is above a determined level, and to disable the electric heating circuit and enable the gas heating burner when the voltage is below the determined value.

5 Claims, 1 Drawing Figure

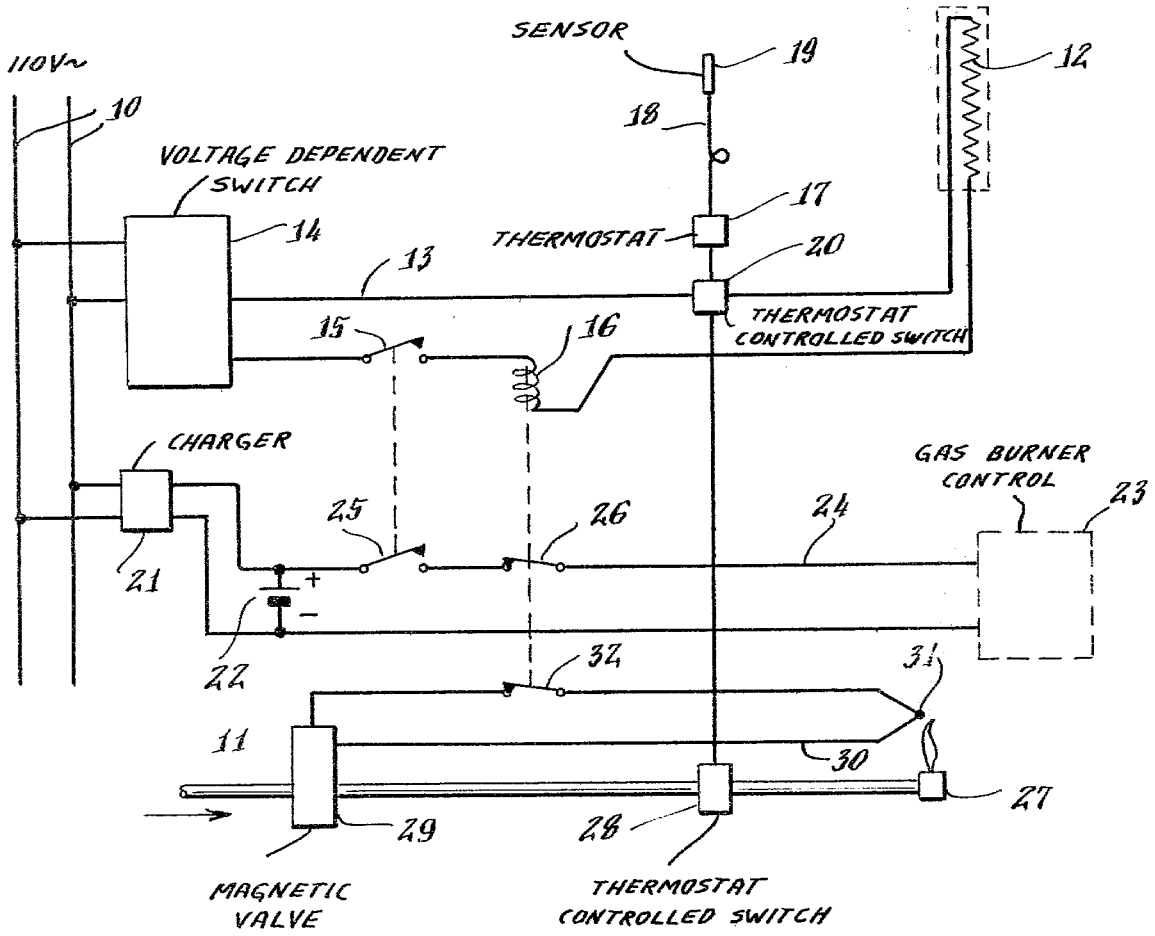
110V~
10
VOLTAGE DEPENDENT SWITCH
14
13
SENSOR
19
18
12
17
THERMOSTAT
20
THERMOSTAT CONTROLLED SWITCH
15
16
CHARGER
21
22
25
26
24
GAS BURNER CONTROL
23
32
31
11
30
27
29
28
MAGNETIC VALVE
THERMOSTAT CONTROLLED SWITCH

CONTROL SYSTEM FOR A REFRIGERATING APPARATUS OPERABLE ELECTRICALLY OR BY GAS

This application is related to co-pending application Ser. No. 49459.

This invention relates to a control system for a refrigerator including absorption refrigerating apparatus, in which the requirements for operational safety are high, and which is adapted to be used in areas where electric mains voltage may vary substantially or is subject to failure.

For storing of certain goods, for example vaccine, it is extremely important that the storing temperatures be maintained at a given level without interruption. There are many refrigerators satisfying this requirement, if the refrigerator can be connected to a reliable electric mains supply for energizing the refrigerator apparatus. However, there are many areas having an electric mains supply with a voltage that has substantial variation and occasionally may fail totally. In such cases, not every refrigerator is suitable. Earlier attempts to solve this problem by using a refrigerator with an absorption refrigerating apparatus operated by kerosene were not successful. For this kind of use, it is a great advantage to have such a refrigerator, but certain difficulties must be considered with regard to its operation, and under all conditions operation by kerosene requires careful supervision of the kerosene fittings, which must be serviced often and regularly.

It may be thought that the above difficulties and troubles could be avoided by choosing instead a refrigerator with absorption refrigerating apparatus operated solely by a gas burner. If there is a mains supply of gas available in this case, it must of course be reliable. Using a gas operated apparatus driven exclusively by bottle gas involves undesired costs, since such supply is comparatively expensive.

The present invention is therefore directed to the provision of means for overcoming the above problem, by providing a refrigerator which can use the local electric supply when the supply voltage is satisfactory but which otherwise automatically switches over the apparatus to gas operation. In accordance with the invention the refrigerating apparatus has an electric heating cartridge in a circuit connected to the current source by way of a voltage-dependent switch, and the gas burner has a control system in an electric circuit fed from a battery connected to the current source by a charging device. The circuit through the heating unit includes means which prevent operation by gas when the circuit is energized.

In order that the invention will be more clearly understood, it will now be discussed in greater detail with reference to the single FIGURE of the drawing, which illustrates schematically, in simplified form, one embodiment of an absorption refrigeration system in accordance with the invention.

The absorption refrigerating apparatus, not shown in the FIGURE, can be of known type. Heat is supplied from either of two alternative sources of energy, of which one is an electric mains supply 10 of for example 110 volts alternating current and the other is a gas conduit 11, either from a gas mains supply or from a gas container. An electric heating unit 12 is connected to the mains supply 10 by a line 13 by way of a voltage-dependent switch 14. This switch can be of known type and is set to break the current in the line 13 if the mains supply voltage falls below a determined value, for example 105 volts and, vice versa, to maintain the line conductive if the voltage is above this value. The line also includes a switch 15 and a relay 16. A thermostat 17 is also provided, and is connected by an impulse conduit 18 connected to a sensor 19 in the refrigerator cabinet. The thermostat 17 controls a switch 20 in the line 13 to the heating unit.

A charging device 21 for a direct current low-voltage battery 22 is also connected to the mains supply 10. The battery is connected to an automatic control system 23 in an electric circuit 24 by way of a switch 25, which can be mechanically coupled to the switch 15 in the mains supply voltage circuit. Contacts 26 controlled by the said relay 16 are also provided in the circuit 24. The control system 23 is designed so that if it receives current from the battery 22, gas flowing out at a gas burner 27 is automatically ignited, whereafter it ensures that the gas remains ignited and that the flame burns. Should this not be the case, the igniting procedure is repeated. The gas burner is also controlled by the thermostat 17, which controls a valve 28 in the gas conduit 11. A safety device is also included in the conduit 11, which in known manner comprises a valve 29 and an electric wire 30 connected to a thermocouple 31 at the gas flame. The conduit 30 also has contacts 32 controlled by the relay 16 in the mains supply voltage circuit. If the mains supply voltage is sufficient for operating the refrigerating apparatus, the switch 32 is disconnected and the gas valve closed so that the flame goes out.

Thus, with the arrangement described it is possible to use electric supply for operating the refrigerator during periods when the supply voltage is sufficient, and at the same time to obtain a system which completely automatically maintains the refrigerator in operation by gas during periods when the supply voltage is insufficient.

Although the invention has been described and disclosed with reference to a single embodiment thereof, it will be apparent that variations and modifications may be made therein, and it is intended in the following claims to cover each such variation and modification as falls within the true spirit and scope of the invention.

What is claimed is:

1. In a control system for an absorption refrigeration apparatus having an electric heating means, gas heating means, and a gas control means for controlling said gas burner means, said gas control means including an electric circuit for igniting and maintaining a flame in said burner means; the improvement wherein said control system further comprises an input for receiving electric supply current, a voltage-dependent switch circuit coupled to said electric heating means for applying electric current thereto from said input when a voltage at said input exceeds a given value, and means coupling the voltage-dependent switch circuit to said electric circuit for enabling said gas control means when voltage at said input is below said given value.

2. The control system of claim 1 wherein said electric circuit further includes a battery for operating said gas control means, said voltage-dependent switch circuit including a relay having contacts for connecting said battery to said electric circuit.

3. The control system of claim 2 further comprising a charger connected to said input for charging said battery in the presence of electric voltage at said input.

4. The control system of claim 1 comprising a relay having a coil connected in series with said electric heating means, said means coupling said voltage-dependent switch circuit to said electric circuit comprising contacts of said relay connected in series with said electric circuit.

5. The control system of claim 4 further comprising a safety system including a safety valve for shutting off supply of gas to said burner means, and a safety circuit responsive to heat of said burner means for controlling said valve, said relay having further contacts connected in series in said safety circuit.

* * * * *